US007470217B2

(12) United States Patent
Jones-Glaser

(10) Patent No.: US 7,470,217 B2
(45) Date of Patent: Dec. 30, 2008

(54) GRIP STRENGTH DEVICE

(76) Inventor: Danielle E. Jones-Glaser, 2231 Pinehurst Ave., St. Paul, MN (US) 55116

( * ) Notice: Subject to any disclaimer, the term of this patent is extended or adjusted under 35 U.S.C. 154(b) by 558 days.

(21) Appl. No.: 11/228,401

(22) Filed: Sep. 19, 2005

(65) Prior Publication Data

US 2006/0063647 A1 Mar. 23, 2006

Related U.S. Application Data

(60) Provisional application No. 60/611,310, filed on Sep. 21, 2004.

(51) Int. Cl.
*A63B 23/16* (2006.01)

(52) U.S. Cl. ..... 482/49; 482/909; 482/49

(58) Field of Classification Search ..... 482/49, 482/44, 47, 10; 73/379.01, 379.02, 379.04; 285/239

See application file for complete search history.

(56) References Cited

U.S. PATENT DOCUMENTS

| | | | | |
|---|---|---|---|---|
| 2,541,520 | A | 2/1951 | Kegel | |
| 2,708,367 | A * | 5/1955 | Lusk | 73/379.02 |
| 3,081,634 | A * | 3/1963 | Blaszkowski | 73/379.09 |
| 3,277,840 | A | 10/1966 | Li | |
| 3,672,219 | A | 6/1972 | Van Patten | |
| 3,742,769 | A | 7/1973 | Crutcher et al. | |
| 3,863,510 | A | 2/1975 | Benson | |
| 4,011,919 | A | 3/1977 | Groeger | |
| 4,050,449 | A | 9/1977 | Castellana et al. | |
| 4,169,391 | A | 10/1979 | Schonberger | |
| 4,222,560 | A * | 9/1980 | Hallerman | 482/49 |
| D274,134 | S | 6/1984 | Sadler | |
| 4,530,496 | A * | 7/1985 | Smith et al. | 482/112 |
| 4,538,459 | A | 9/1985 | Vandenbergh | |
| 4,574,791 | A | 3/1986 | Mitchener | |
| 4,895,363 | A | 1/1990 | Plevnik et al. | |
| 4,943,053 | A | 7/1990 | Smith | |
| 4,949,729 | A | 8/1990 | Haski | |
| 4,951,514 | A | 8/1990 | Gubin | |
| 5,085,088 | A | 2/1992 | Robinson et al. | |
| 5,157,970 | A | 10/1992 | Lewis, Jr. | |
| 5,213,557 | A | 5/1993 | Firth | |

(Continued)

FOREIGN PATENT DOCUMENTS

| | | |
|---|---|---|
| GB | 328599 | 4/1930 |

(Continued)

*Primary Examiner*—Jerome W. Donnelly
(74) *Attorney, Agent, or Firm*—Richard C. Litman

(57) ABSTRACT

The grip strength device is configured to gauge the grip strength of contracted muscles or aid in exercising particular muscles by providing resistance against the contracted muscles. The grip strength device is inserted into a user's vagina or held in a user's hand. The user either contracts the pubococcygeal or hand muscles depending on the casing used. The grip strength device has a removable casing containing a first fluid, a first bellows, a second bellows and a pressure gauge. The first bellows has a closed end and a first valve in communication with the casing. The second bellows has a second fluid. The second bellows has a second valve connected to the pressure gauge, and a closed end abutting the closed end of the first bellows. Pressure applied to the removable casing is communicated from the first bellows to the second bellows and measured by the pressure gauge.

20 Claims, 6 Drawing Sheets

U.S. PATENT DOCUMENTS

| | | | | |
|---|---|---|---|---|
| 5,336,140 | A | | 8/1994 | LeBlond |
| 5,407,412 | A | | 4/1995 | Plevnik et al. |
| 5,562,717 | A | | 10/1996 | Tippey et al. |
| 5,643,138 | A | * | 7/1997 | Huang ..... 482/4 |
| 5,674,238 | A | | 10/1997 | Sample et al. |
| 5,702,428 | A | | 12/1997 | Tippey et al. |
| 5,733,230 | A | | 3/1998 | Sawchuck et al. |
| 5,931,775 | A | | 8/1999 | Smith |
| 6,063,045 | A | | 5/2000 | Wax et al. |
| 6,086,016 | A | | 7/2000 | Meek |
| 6,086,516 | A | * | 7/2000 | Santos ..... 482/5 |
| 6,086,549 | A | | 7/2000 | Neese et al. |
| 6,217,529 | B1 | | 4/2001 | Wax et al. |
| 6,224,580 | B1 | | 5/2001 | Christensen |
| 6,327,922 | B1 | | 12/2001 | Hewatt |
| 6,370,912 | B1 | | 4/2002 | Sutton |
| 6,406,411 | B1 | | 6/2002 | Guagliano et al. |
| 6,458,008 | B1 | | 10/2002 | Hyneman |
| 6,526,306 | B2 | | 2/2003 | Johnson et al. |
| 6,562,018 | B1 | | 5/2003 | Russell |
| 6,568,291 | B1 | | 5/2003 | Inman |
| 6,604,706 | B1 | | 8/2003 | Bostan |
| 6,648,842 | B2 | | 11/2003 | Horkel |
| 6,672,996 | B2 | | 1/2004 | Ross et al. |
| 2003/0087734 | A1 | | 5/2003 | Kring et al. |
| 2003/0220589 | A1 | | 11/2003 | Leviseth et al. |
| 2004/0040756 | A1 | | 3/2004 | Nmngani |
| 2004/0104303 | A1 | | 6/2004 | Mao |
| 2004/0173037 | A1 | | 9/2004 | Guerrero |

FOREIGN PATENT DOCUMENTS

| | | |
|---|---|---|
| GB | 1145749 | 3/1969 |
| GB | 2058571 | 4/1981 |
| GB | 2119516 | 11/1983 |
| JP | 6-154273 | 6/1994 |
| JP | 7-194663 | 8/1995 |

* cited by examiner

GRIP STRENGTH DEVICE

CROSS-REFERENCE TO RELATED APPLICATION

This application claims the benefit of U.S. Provisional Patent Application Ser. No. 60/611,310, filed Sep. 21, 2004.

FIELD OF THE INVENTION

The present invention relates to exercise devices and to measuring devices, and particularly to a device for measuring or strengthening the grip strength of muscles.

DESCRIPTION OF THE RELATED ART

Pubococcygeal muscles, or pelvic floor muscles, may often become weaker over the course of an individual's lifetime due to such activities as childbirth or becoming overweight. Weak pubococcygeal muscles provide a number of problems for women, including urinary incontinence or sexual dysfunction. For these women, strengthening the pelvic floor muscles can often provide a remedial benefit for the disorders that plague them. Further, some women may not experience a weakening of these muscles, but may still want to increase the strength of the pelvic floor muscles because of the added benefit to sexual stimulation.

A variety of methods for treating these disorders abound, including surgical and non-surgical options. While surgery is available, many individuals prefer a non-surgical, non-invasive approach. Several devices exist that either exercise the pubococcygeal muscles or provide resistance for individuals so that they may exercise their muscles by contracting against the devices and thereby strengthening the muscles. Additionally, it is a benefit to users to be able to measure muscle strength in order to determine whether the exercises they have engaged in are helping to strengthen the muscles. It would therefore be beneficial to provide a single device that both allows the user to strengthen her pubococcygeal muscles and additionally to determine whether the muscles are actually being strengthened. Numerous devices are available on the market to aid in exercising the pelvic floor muscles, and that also indicate whether the strength of a user's muscles have increased after repeated use.

However, women are of various sizes, and an exercise device that takes this into account would be helpful. A device that uses a removable outer covering would allow women of varying sizes to use the exercise device.

Pubococcygeal muscle strength testers or exercisers are shown or described in Japanese Patent No. 6,154,273, published Jun. 3, 1994 (exerciser for strengthening perineal muscles); Japanese Patent No. 7,194,663, published Aug. 1, 1995 (perineum exerciser); on a web page published on the cardiodesign.com.au website on the World Wide Web (peritron perineometer), at least as of Jun. 23, 2004; a web page published on the winhealth.co.uk website on the World Wide Web (PFX and peritron), at least as of Jun. 23, 2004; and a web page published at the libida.com website on the World Wide Web (perineometer), at least as of Jun. 23, 2004.

Additionally, hand muscles may become weakened or damaged due to accidents, war-related injuries or arthritis. Exercise devices capable of both strengthening and testing hand muscles would be quite helpful. Particularly beneficial would be exercise devices that provide removable coverings so that different combinations of fingers may be tested or exercised at various times.

Accordingly, there is a need for a device that can both exercise and test the strength of specific muscles, in particular, the hand and pubococcygeal muscles. Further, there is a need for a device that has a removable outer covering so that a number of different muscles can be tested at different times, and the device may be used for individuals of varying sizes.

SUMMARY OF THE INVENTION

The grip strength device is a device used to gauge the grip strength of contracted muscles, or to aid in exercising particular muscles by providing resistance against the contracted muscles. The grip strength device is inserted into a user's vagina or held in a user's hand. The user either contracts the pubococcygeal or hand muscles depending on the casing used. The grip strength device comprises a removable casing containing a first fluid, a first bellows, a second bellows and a pressure gauge. The first bellows has a closed end and a first valve in communication with the casing. The second bellows has a second fluid. The second bellows has a second valve connected to the pressure gauge, and a closed end abutting the closed end of the first bellows. Pressure applied to the removable casing is communicated from the first bellows to the second bellows and measured by the pressure gauge.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a grip strength device, configured particularly to gauge the grip strength of contracted muscles. However, the present grip strength device may additionally be used to aid in exercising particular muscles by providing resistance against the contracted muscles. The present device generally functions with pubococcygeal or hand muscles.

Figure 1A:
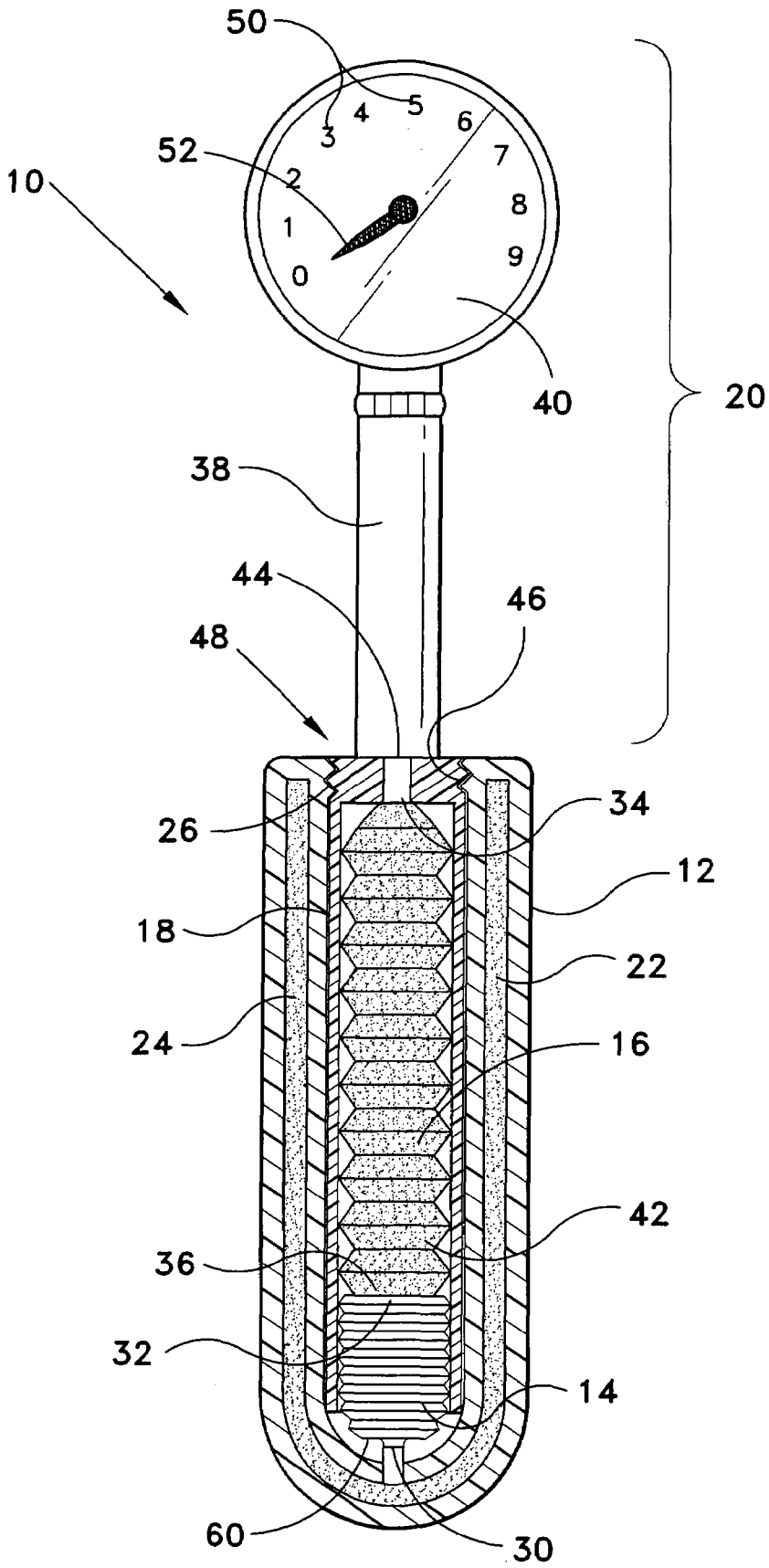
FIG. 1A is a front view of a grip strength device according to a first embodiment of the present invention in its normal state with the casing shown in section.

FIG. 1A of the drawings provides a front view of a first embodiment of the present grip strength device 10 with a casing 12 shown in section. The grip strength device 10 has an elongated removable casing 12, a first bellows 14, a second bellows 16, and a pressure gauge 20. The first 14 and second 16 bellows are compression devices that are able to expand and contract based upon the amount of fluid retained therein. While bellows are shown, other resilient devices capable of expansion and contraction according to pressure applied to a fluid contained therein may be substituted for bellows.

The removable casing 12 is made from a material soft enough to compress when muscles contract around the casing 12, for example, latex, silicone, vinyl, rubber, silk, acrylic, etc. The casing 12 has a hollow cavity 22 containing a first fluid 24. The casing 12 has a plurality of internal threads 26 (shown more clearly in FIG. 2) disposed along a top inner portion 28 of the casing 12. The first bellows 14 is comprised of a soft, flexible material and has a first valve 30 and a closed end 32. The first bellows 14 is connected to the casing 12 by the valve 30. The removable casing 12 and the first bellows 14 form a first fluid system partially filled with the first fluid 24. Upon compression of the casing 12, the first fluid 24 moves from the hollow cavity 22 of the casing 12 through the valve 30 into the first bellows 14.

The second bellows 16 is made from a soft, flexible material and has a second valve 34 and a closed end 36. The pressure gauge 20 is in communication with the second valve 34. The second bellows 16 holds a second fluid 42. The second bellows 16 and the pressure gauge 20 form a second fluid system. The pressure gauge 20 is comprised of a tube 38 connected to a pressure-indicating dial 40 with indicia 50 thereon. An indicator 52 is mounted to the pressure-indicating dial 40 and indicates specific pressure levels. The second valve 34 is joined to the tube 38. When the second bellows 16 is compressed, the second fluid 42 is forced into the tube 38 of the pressure gauge 20. The pressure gauge 20 then measures the pressure exerted on the second fluid system and indicates the pressure on the dial 40. While a dial-type pressure gauge is shown, a linear gauge, electronic LED read-out gauge or any other suitable pressure-indicating means may additionally be used.

A hollow, rigid sheath 18 may additionally be included to protect the first 14 and second 16 bellows. The sheath 18 is made from a hard material, such as hard latex, glass, rubber, metal, acrylic, stainless steel, copper, brass, etc. The sheath 18 is attached to an end 44 of the tube 38, encases the second bellows 16, and extends past the closed end 36 of the second bellows 16. The sheath 18 has a plurality of external threads 46 disposed along a top outer portion 48 of the sheath 18. The internal threads 26 of the casing 12 mate with the external threads 46 of the sheath 18 to secure the casing 12 to the sheath 18. The pressure gauge 20, second bellows 16 and sheath 18 are threaded onto the casing 12, causing the closed end 36 of the second bellows to abut the closed end 32 of the first bellows 14. Once the second bellows 16 and sheath 18 are inserted within the casing 12, the sheath 18 extends past the second bellows 16 and surrounds the first bellows 14, providing a rigid shell between the casing 12 and the first 14 and second 16 bellows.

The grip strength device 10 is inserted into a user's vagina or held in a user's hand. The user either contracts the pubococcygeal muscles around the casing 12 of the grip strength device 10 if inserted into the vagina, or squeezes their hand around the casing 12 of the grip strength device 10. The device 10 may additionally be used by an individual to strengthen muscles when the user contracts the pubococcygeal muscles or compresses their hand or fingers around the device 10.

Figure 1B:
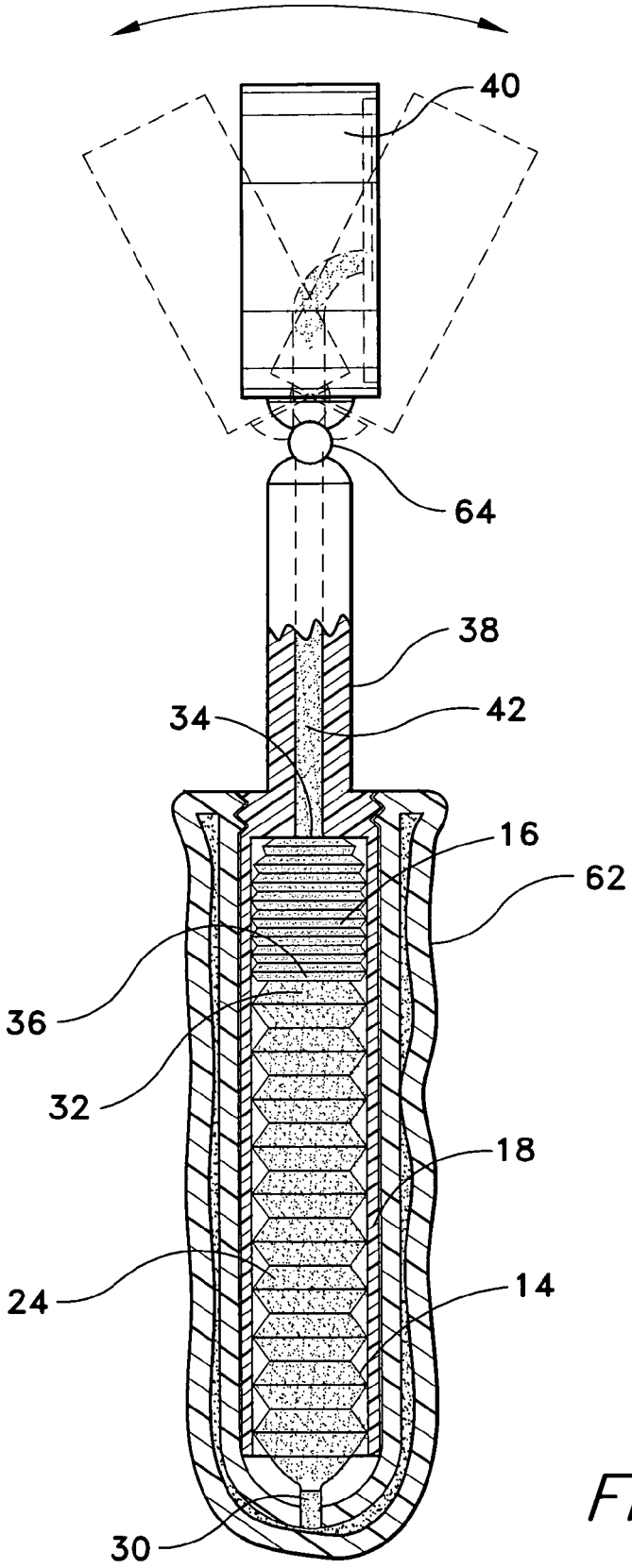
FIG. 1B is a front view of the grip strength device according to the first embodiment of the present invention with the casing shown in section and in a compressed state, as during exercise or strength testing.

FIG. 1B shows the grip strength device 10 when compressed. An outside pressure is applied to an outer portion 62 of the removable casing 12, which forces the first fluid 24 through the first valve 30 into the first bellows 14. As the outer portion 62 of the removable casing 12 is soft, the casing 12 is easily compressible. The sheath 18 is hard and rigid, preventing the first 14 and second 16 bellows from being affected by the compression. The first bellows 14 then expands as the first fluid 24 enters the first valve 30. During expansion, the closed end 32 of the first bellows 14 pushes against the closed end 36 of the second bellows 16. The second bellows 16 contracts, forcing the second fluid 42 through the second valve 34 and into the tube 38. The pressure gauge 20 is then able to measure the pressure exerted on the second fluid system. Therefore, the outside pressure applied to the removable casing 12 is communicated from the first bellows 14 to the second bellows 16 and measured by the pressure gauge 20. The indicator 52 reflects the changes in pressure.

In addition, the pressure dial 40 has a hinge 64, which allows the pressure dial 40 to tilt so that when the grip strength device 10 is inserted within a vagina, the user will be able to read the dial 40 as the device 10 is being used.

Figure 2:
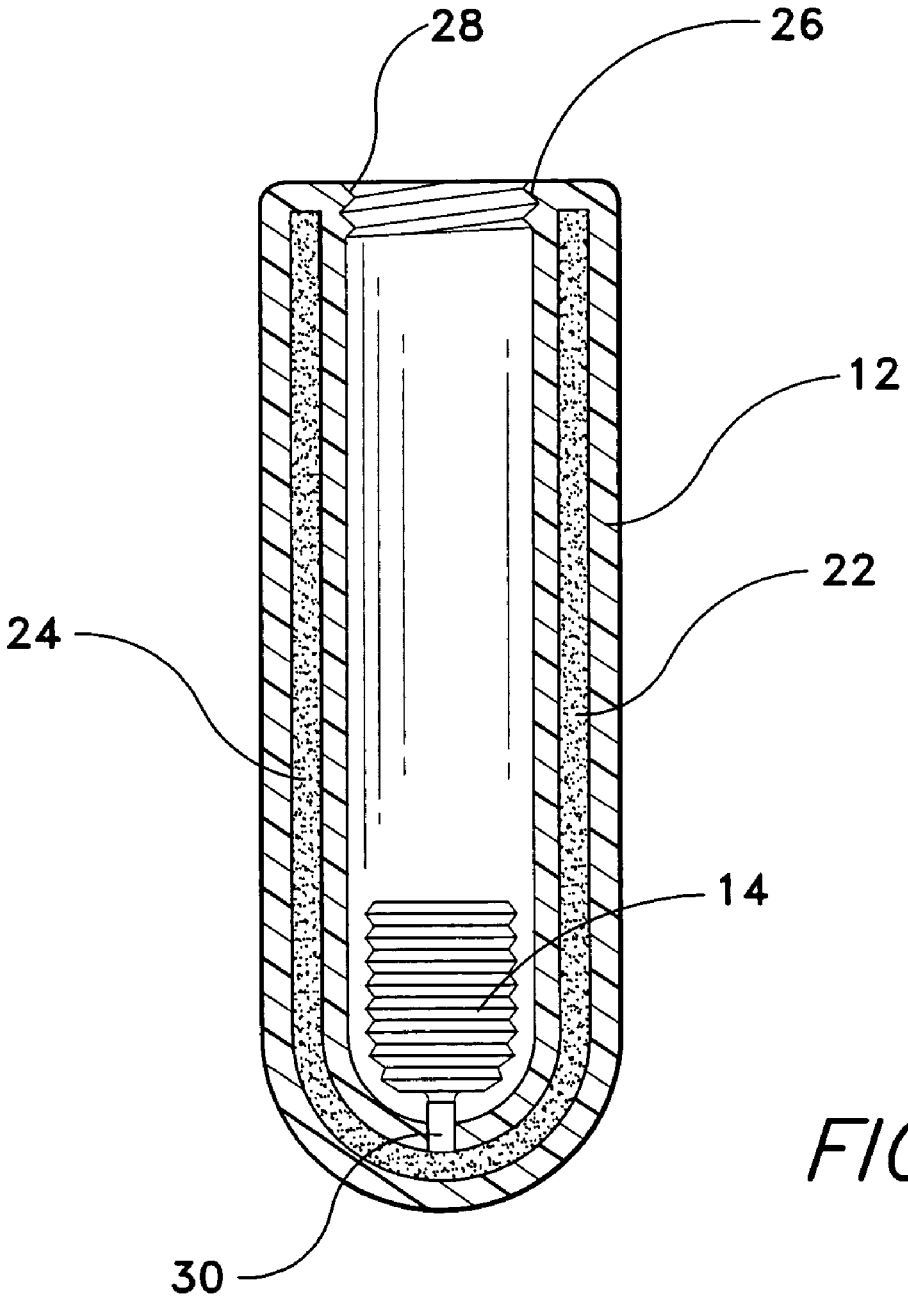
FIG. 2 is a detailed front view of the casing of the grip strength device in vertical section.

Turning now to FIG. 2, the removable casing 12 and the first bellows 14 are shown, the casing 12 being shown in section. The first bellows 14 is attached to the casing 12 through the first valve 30. The first fluid 24 is suspended within the hollow cavity 22 of the casing 12. Internal threads 26 are disposed on the top inner portion 28 of the casing 12.

Figure 3:
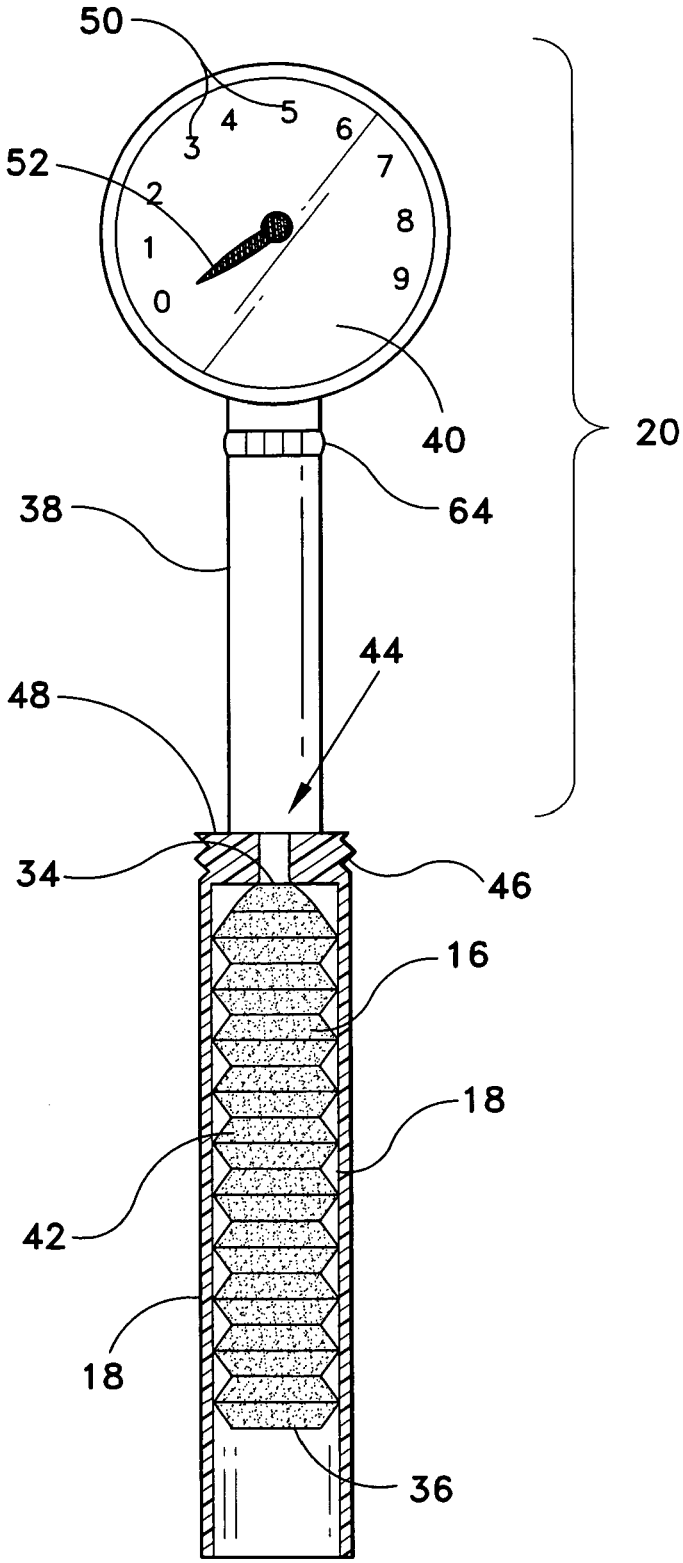
FIG. 3 is a front view of a pressure gauge and sheath of the grip strength device with the sheath in vertical section.

FIG. 3 shows the pressure gauge 20, the second bellows 16 and the sheath 18, the sheath 18 being shown in section. The pressure gauge 20 comprises a tube 38 through which the second fluid 42 moves and a pressure indicating dial 40. The second fluid 42 is compressed into the tube 38, and the pressure-indicating dial 40 registers changes in pressure based on the amount of the second fluid 42 compressed.

The sheath 18 is connected to the end 44 of the tube 38 and encases the second bellows 16. The sheath 18 is rigid and extends past the closed end 32 of the second bellows 16, such that when the sheath 18 is inserted within the casing 12, the sheath 18 additionally encases the first bellows 14. External threads 46 are located along the top outer portion 48 of the sheath 18 and are designed to mate with the internal threads 26 located along the top inner portion 28 of the casing 12.

Figure 4:
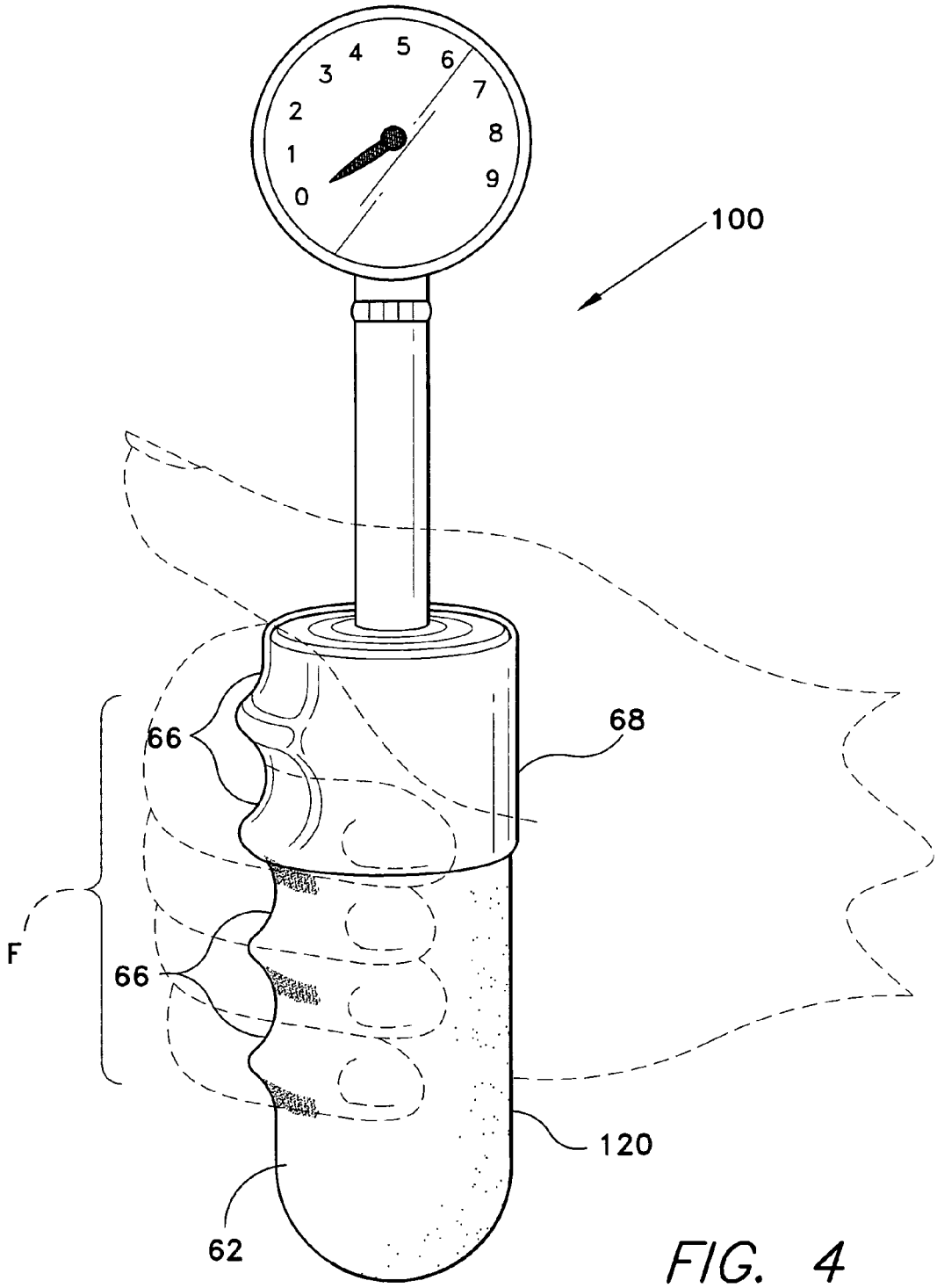
FIG. 4 is an environmental perspective view of the grip strength device according to a second embodiment of the present invention.

FIG. 4 of the drawings provides an environmental perspective view of a second embodiment of the grip strength device 100. The second embodiment of the grip strength device 100 is used to exercise or test the strength of hand muscles. The casing 120 has a plurality of grooves 66 located along the outer portion 62 of the casing 120. A user places the user's fingers F within the plurality of grooves 66. The user is then able to hold and press the grip strength device 100.

A hard, rigid outer lining 68 covers part of the casing 120. It will be understood that although the drawing shows only the upper two finger grooves covered by lining 68, the invention is not restricted to the portion identified in the drawings, but rather the extent of the lining 68 varies depending on which fingers F the user chooses to test. The hard outer lining 68 covers at least one of the grooves 66. The user compresses the grip strength device 100 with the fingers F that are located on the soft portion of the casing 120, allowing the pressure gauge 20 to indicate a specific pressure level. The fingers F that are situated within grooves 66 lined with the hard outer lining 68 are not able to compress the casing 120. Therefore, only the strength of certain fingers F is able to be determined.

Figure 5:
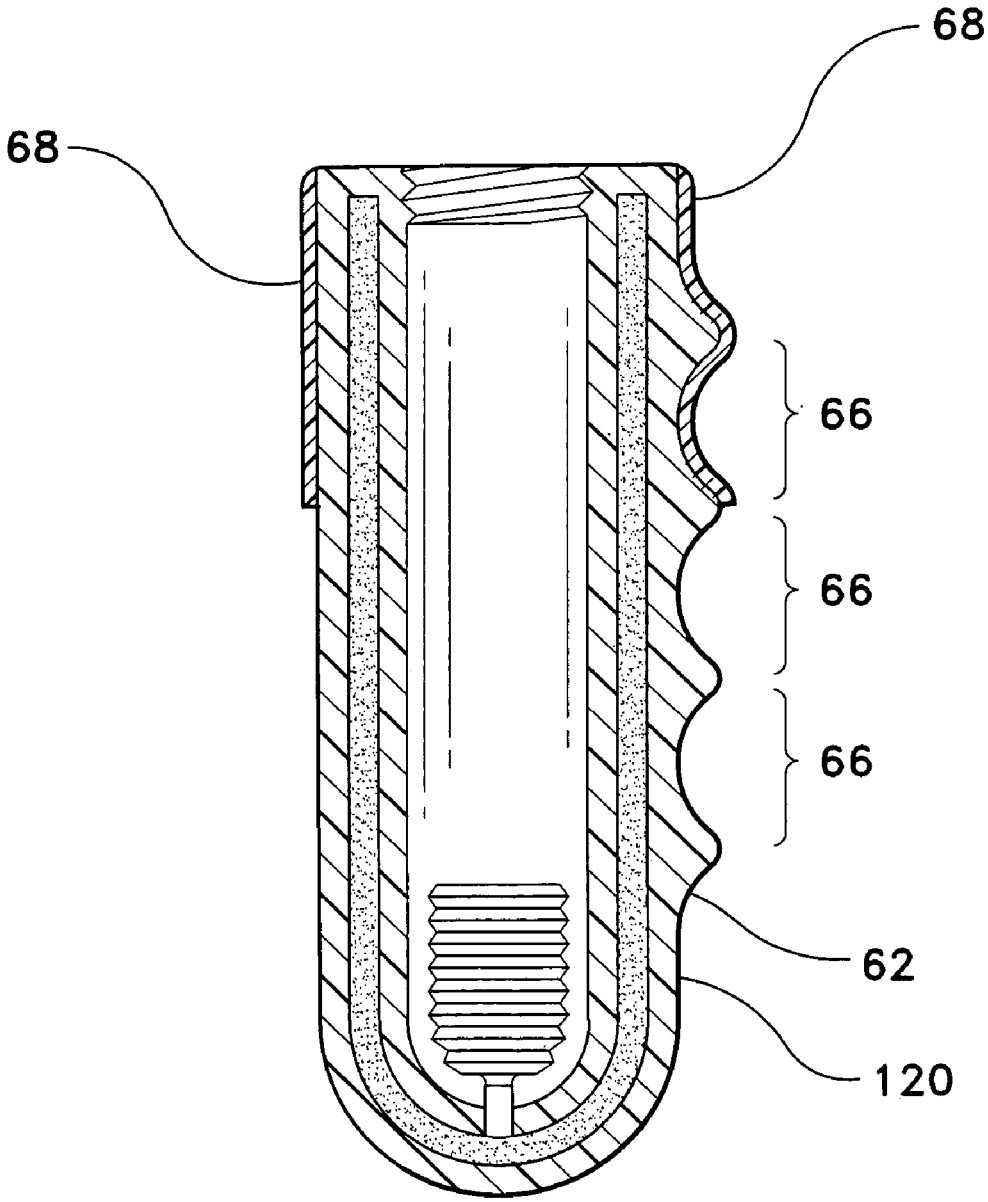
FIG. 5 is a front view of the casing of the grip strength device of FIG. 4 in vertical section.

FIG. 5 of the drawings provides a front view of the casing 120 shown in section. The outer portion 62 of the casing 120 has a plurality of grooves 66 designed to fit a user's fingers F.

The hard outer lining 68 covers part of the casing 12. The hard outer lining 68 covers at least one of the grooves 66. The user compresses the grip strength device 100 on the soft portion of the casing 120. The fingers F that are situated within grooves 66 lined with the hard outer lining 68 are not able to compress the casing 120.

As the casing 120 is removable, numerous types of casings may be used with the grip strength device 100. The hard lining 68 may cover one, two or more of the grooves 66 in order to exercise or test the strength of specific fingers F. Additionally, the casing 12 used for testing pubococcygeal muscles may be substituted for the casing 120 used for testing hand muscles. The grip strength device 10 used for testing or strengthening pubococcygeal muscles may use removable casings 12 in a number of sizes depending on the individual woman.

It is to be understood that the present invention is not limited to the embodiments described above, but encompasses any and all embodiments within the scope of the following claims.

I claim:

1. A device for measuring grip strength of muscles, comprising:

a removable casing containing a first fluid;

a first bellows having a closed end, the first bellows being in fluid communication with the casing, the first bellows and the casing forming a first fluid system partially filled with the first fluid;

a second bellows containing a second fluid, the second bellows having a closed end abutting the closed end of the first bellows and forming a second fluid system; and means for measuring and displaying pressure exerted on the second fluid system by the first fluid system when the casing is compressed.

2. The device for measuring grip strength according to claim 1, further comprising a first valve connected between the casing and the first bellows, the first valve providing fluid communication between the casing and the first bellows.

3. The device for measuring grip strength according to claim 1, further comprising a rigid sheath disposed between the casing and the first and second bellows.

4. The device for measuring grip strength according to claim 1, wherein said means for measuring and displaying pressure comprises:

a second valve connected to said second bellows;

a tube extending from the second valve; and a pressure gauge connected to the tube;

whereby said first bellows expands when said casing is compressed, thereby compressing said second bellows and forcing fluid into the tube, the pressure gauge measuring and displaying the pressure.

5. The device for measuring grip strength according to claim 4, further comprising a hinge joining said pressure gauge to said tube.

6. The device for measuring grip strength according to claim 4, wherein said pressure gauge is selected from the group consisting of a dial-indicator gauge, a linear gauge, and an electronic LED read-out gauge.

7. The device for measuring grip strength according to claim 1, wherein said casing is cylindrical, being adapted for insertion into a woman's vagina for measuring the grip strength of vaginal muscles.

8. The device for measuring grip strength according to claim 1, wherein said casing has a plurality of finger grooves defined therein, whereby the device is adapted for measuring finger grip strength.

9. The device for measuring grip strength according to claim 8, further comprising a rigid outer lining disposed over at least one of the finger grooves, whereby the device is adapted for measuring the grip strength of fewer than all of the fingers of a hand.

10. A device for measuring grip strength of muscles, comprising:

a removable casing containing a first fluid;

a first bellows having a closed end and having a first valve forming a fluid conduit between the first bellows and the casing;

a second bellows containing a second fluid, the second bellows having a second valve and having a closed end abutting the closed end of the first bellows; and a pressure gauge connected to the second valve;

whereby pressure applied to the removable casing is communicated from the first bellows to the second bellows and measured by the pressure gauge.

11. The device for measuring grip strength according to claim 10, further comprising a rigid sheath disposed between the casing and the first and second bellows.

12. The device for measuring grip strength according to claim 10, further comprising a tube disposed between said second valve and said pressure gauge.

13. The device for measuring grip strength according to claim 12, further comprising a hinge joining said pressure gauge to said tube.

14. The device for measuring grip strength according to claim 10, wherein said pressure gauge is selected from the group consisting of a dial-indicator gauge, a linear gauge, and an electronic LED read-out gauge.

15. The device for measuring grip strength according to claim 10, wherein said casing is cylindrical, being adapted for insertion into a woman's vagina for measuring the grip strength of vaginal muscles.

16. The device for measuring grip strength according to claim 10, wherein said casing has a plurality of finger grooves defined therein, whereby the device is adapted for measuring finger grip strength.

17. The device for measuring grip strength according to claim 16, further comprising a rigid outer lining disposed over at least one of the finger grooves, whereby the device is adapted for measuring the grip strength of fewer than all of the fingers of a hand.

18. A device for measuring grip strength of muscles, comprising:

a removable casing defining a cavity, the casing being compressible;

a first fluid disposed within the cavity of the casing;

a first bellows having a closed end and having a first valve forming a fluid conduit between the first bellows and the casing cavity;

a second bellows having a second valve and having a closed end abutting the closed end of the first bellows;

a second fluid disposed within the second bellows;

a tube extending from the second valve, the second valve forming a fluid conduit between the second bellows and the tube;

a rigid sheath extending axially between the casing and the first and second bellows; and a pressure gauge connected to the tube;

whereby pressure applied to the removable casing is communicated from the first bellows to the second bellows and measured by the pressure gauge.

19. The device for measuring grip strength according to claim 18, wherein said casing is cylindrical, being adapted for insertion into a woman's vagina for measuring the grip strength of vaginal muscles.

20. The device for measuring grip strength according to claim 18, wherein said casing has a plurality of finger grooves defined therein, whereby the device is adapted for measuring finger grip strength.

* * * * *